US006012196A

United States Patent [19]

Weiss

[11] Patent Number: 6,012,196

[45] Date of Patent: Jan. 11, 2000

[54] PAINT ROLLER RETAINER

[76] Inventor: Sherman L. Weiss, 11360 Sherman Way, Sun Valley, Calif. 91352-4944

[21] Appl. No.: 09/130,622

[22] Filed: Aug. 7, 1998

[51] Int. Cl.[7] ..... B05C 1/08

[52] U.S. Cl. ..... 15/230.11; 492/19

[58] Field of Search ..... 15/230.11; 492/13, 492/15, 19; D4/122

[56] References Cited

U.S. PATENT DOCUMENTS

| | | | |
|---|---|---|---|
| 756,695 | 4/1904 | Peterson . | |
| 922,148 | 5/1909 | Kariya . | |
| 2,225,517 | 12/1940 | Barker . | |
| 2,887,711 | 5/1959 | Hutchinson . | |
| 2,907,061 | 10/1959 | Whalen . | |
| 2,951,256 | 9/1960 | Hulsh . | |
| 2,982,981 | 5/1961 | Waara . | |
| 3,085,270 | 4/1963 | Vosbikian et al. . | |
| 3,115,659 | 12/1963 | Church . | |
| 3,274,637 | 9/1966 | Schulze . | |
| 3,346,899 | 10/1967 | Murphy . | |
| 3,378,872 | 4/1968 | Frontera et al. . | |
| 3,418,673 | 12/1968 | Kruth . | |
| 3,421,822 | 1/1969 | Roche . | |
| 3,942,209 | 3/1976 | Walls . | |
| 4,528,712 | 7/1985 | Leibow . | |
| 4,829,623 | 5/1989 | Brezette et al. . | |
| 4,985,958 | 1/1991 | Garcia . | |
| 5,014,384 | 5/1991 | Brezette et al. . | |
| 5,755,004 | 5/1998 | Miller | 15/230.11 |
| 5,806,129 | 9/1998 | Nelson | 15/230.11 |

FOREIGN PATENT DOCUMENTS

| | | |
|---|---|---|
| 887294 | 1/1962 | United Kingdom . |
| 954819 | 4/1964 | United Kingdom . |

*Primary Examiner*—Gary K. Graham

*Attorney, Agent, or Firm*—Marshall A. Lerner, Esq.; Bradford E. Mattes, Esq.; Kleinberg & Lerner, LLP

[57] ABSTRACT

A paint roller incorporates a free end cap having a tab or tabs capable of being rotated into a position that prevents the paint roller's cylindrical brush from sliding over the end cap when painting.

2 Claims, 1 Drawing Sheet

PAINT ROLLER RETAINER

BACKGROUND

This invention is a paint roller applicator for retaining a paint roller brush on a paint roller cage.

A typical paint roller, as contemplated for use in combination with the instant invention, comprises a handle, a rigid shaft extending from the handle, a cage rotatably attached to the rigid shaft, the cage further having a handle end and a free end, a cylindrical shaped handle end cap affixed to the end of the cage where the shaft enters the cage from the handle, and a cylindrical shaped free end cap affixed to the other end of the cage where the shaft terminates. A cylindrical paintbrush (also known as a "cover" or "brush" is affixed to and surrounds the cage and part of each end cap in such a manner that the brush, end caps, and cage rotate together. In the normal course of operation, a user grasps the handle and dips the brush in a paint container so that its outer surface absorbs paint. The user then grasps the handle to manually apply the outer surface of the brush to the surface to be painted by rolling it against the surface.

The brush in a typical paint roller is affixed to the cage and end caps by means of a press fit or interference fit. To be practical, this fit between the cage and cylindrical brush must be loose enough to enable the brush to be slipped over the cage and end caps by hand. In achieving that looseness, however, the brush is at risk of sliding off the cage during use. The present invention overcomes this problem by incorporating a positive stop feature in the free end cap to prevent the cover from sliding during use.

No known prior art paint rollers incorporate any such positive stop feature.

U.S. Pat. No. 3,115,659 to Church; U.S. Pat. No. 3,274,637 to Schulze; U.S. Pat. No. 5,014,384 to Brezette et al., and United Kingdom patent, no. 887,294 to Ashley all disclose a paint roller wherein the brush resides in a single-piece housing. In each of those patents, the housing, among other things, acts as a barrier to keep the cover from sliding off the roller. Although the housings shown in those prior art patents prevent their respective roller paint brushes from sliding completely off of the cage, they do not disclose any means or structure, as is the case in the present invention, to prevent the brush from sliding into and thereby rubbing against the housing during use. Additionally, because all of these housings are attached at both ends of the cage, these inventions do not permit ready removal and replacement of roller covers.

The paint rollers disclosed in U.S. Pat. No. 3,378,872 to Frontera et al.; U.S. Pat. No. 3,085,270 to Vosbikian et al.; U.S. Pat. No. 4,528,712 to Leibow; and U.S. Pat. No. 4,985,958 to Garcia do not disclose any means for ready removal and replacement of the brush. Nor do any of those patents disclose any positive stop feature for retaining the brush.

In light of the foregoing shortcomings in the prior art, a paint roller is needed that will allow the user to readily remove and replace the roller brush without leaving the brush at risk of sliding with respect to the cage when painting.

SUMMARY

The present invention provides a paint roller retainer which prevents the paint roller's cylindrical brush from sliding over the end cap when painting. This is achieved by incorporating a positive stop feature in the free end cap in the form of a tab or tabs rotatably mounted on the free end cap. To install or remove a brush, the tab or tabs are rotated into a position where they do not interfere with any sliding movement of the brush on the cage. To keep the brush from sliding with respect to the cage during painting operations, the tab or tabs are rotated into a position such that the tab or tabs extend beyond the surface of the end cap.

The preferred version of the paint roller brush retainer of the present invention (also referred to herein as a "retainer") comprises:

(a) a roller cage having a handle end and a free end;

(b) an end cap affixed to the handle end of the roller cage (hereinafter the "handle end cap)";

(c) an end cap affixed to the free end of the roller cage (hereinafter the "free end cap"), the free end cap further having a cylindrical surface and a flat surface;

(d) a tab rotatably attached to the flat surface of the handle end cap in such a manner that it can be rotated so that it is entirely within the flat surface of the handle end cap or further rotated so that it extends beyond the flat surface of the handle end cap; and (e) a roller brush.

DRAWINGS

These and other features and advantages of the present invention will be better understood by referring to the following description, claims, and accompanying drawings in which:

DESCRIPTION

Figures 1, 2, 3:
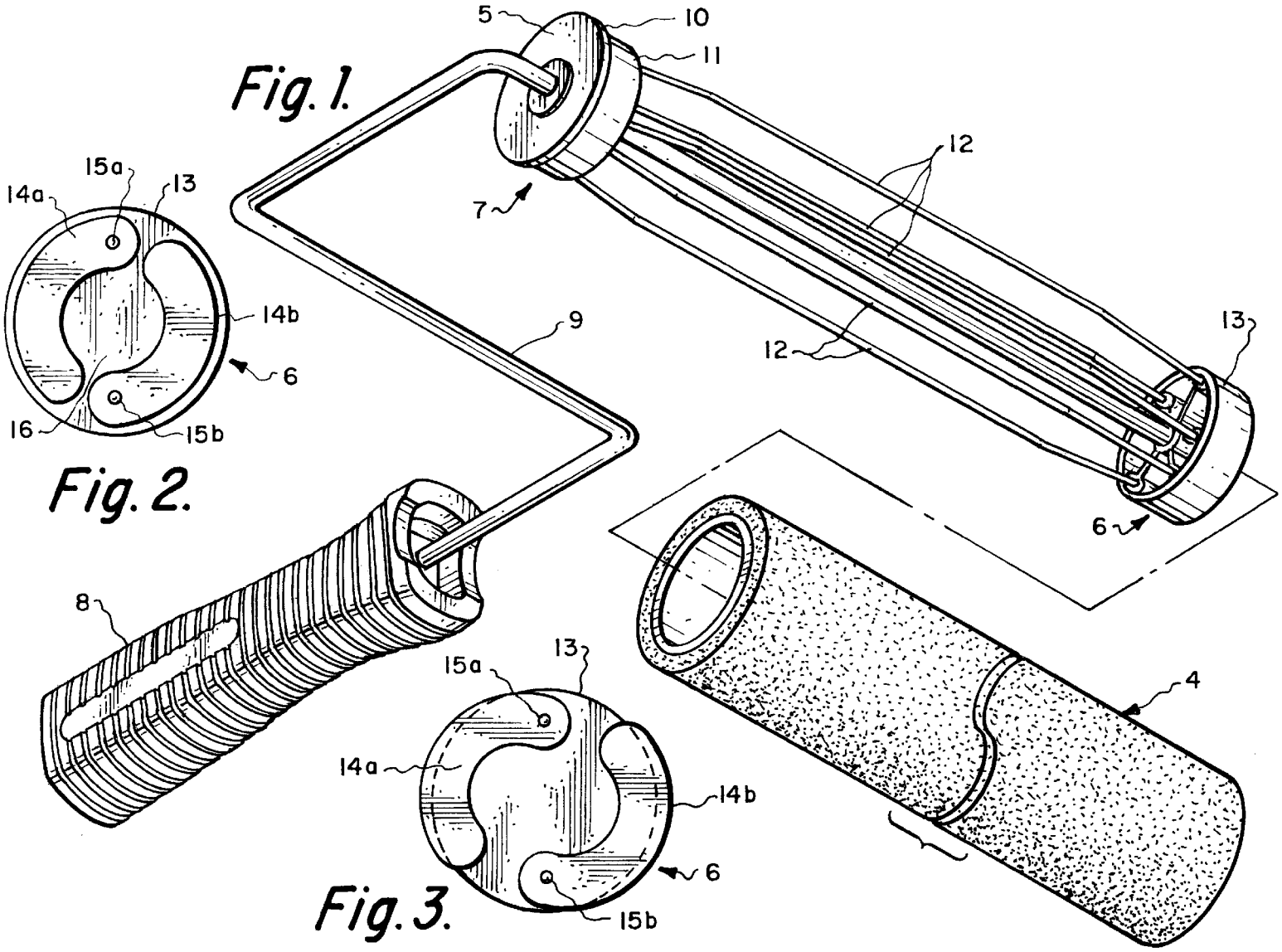
FIG. 1 is a perspective view of a paint roller applicator.
FIG. 2 is an enlarged side view of the free end cap shown in FIG. 1.
FIG. 3 is a view of FIG. 2 wherein each tab is shown extending beyond the flat surface of the free end cap.

As shown in FIG. 1, a paint roller comprises a handle 8 to which is attached a shaft 9. A roller cage 12 having a handle end cap 7 and a free end cap 6 is rotatably mounted on the shaft 9 so that the handle end cap 7 is closer to the handle 8 than the free end cap 6 when measured along the shaft 9. The cage 12 is held together by the handle end cap 7 and the free end cap 6 which each rotate about the shaft 9.

The handle end cap 7 has a cylindrical surface 11 for receiving the roller brush 4 and a flat surface 5 that extends concentrically beyond the cylindrical surface 11 to form a lip 10 that acts as a positive stop to prevent the roller brush 4 from sliding completely over the handle end cap 7.

The free end cap 6 also has a cylindrical surface 13 for receiving the roller brush and a flat surface 16 whose perimeter is flush with the cylindrical surface 13 so that a roller cover may be installed or removed by sliding it over the cylindrical surface 13.

Tabs 14*a* and 14*b*, as shown in FIG. 2, are mounted to the flat surface 16 of the free end cap 6 at, respectively, pivots 15*a* and 15*b*. To eliminate sliding of the roller brush, tabs 14*a* and 14*b* are rotated outwardly to a point where any sliding by the roller brush toward the free end cap 6 will be halted by the tabs as shown in FIG. 3.

Friction at pivots 15*a* and 15*b* respectively holds tabs 14*a* and 14*b* in any position selected by the user. Tabs 14*a* and 14*b* are further held in such positions by friction between the tabs 14*a,b* and the flat surface 16. Alternatively, the tabs 14*a,b* may be held in position by a tang and corresponding slot (not shown) formed into, respectively, each tab and flat surface.

To remove or install a roller cover on a paint roller embodying the invention described herein, the user manually rotates the tabs 14*a,b* until no portion of either one of them extends beyond the cylindrical surface 13 of the free end cap 6. When the tabs 14*a,b* are positioned in such an orientation, the roller brush is free to slide over the free end cap 6 in either direction thereby permitting removal or installation of a roller brush.

To lock a roller brush into place on the roller cage 12 so that the roller brush will not slide along the longitudinal axis during use, the tabs 14*a,b* are rotated into a position where they extend beyond the cylindrical surface 13.

Each version of the present invention described above has many advantages. The ability to lock the roller brush into place and thereby prevent it from sliding while being used will eliminate mishaps that would otherwise result. The ability of the tabs to be held in the correct position while the roller brush rotates ensures that the roller brush will remain in place throughout rolling operations.

Although the present invention has been described in detail with reference to certain preferred versions, other versions are possible. For example, the tabs could be shaped and positioned so that rotating a single tab outwardly would cause the other tab to rotate outwardly an equal amount.

Alternatively, a third tab having a double cam could be pivotably mounted in the center of the flat surface of the free end cap in such a manner that when the third tab is rotated it pushes both of the other tabs outward an equal and controlled amount.

In another embodiment, the tabs 14*a,b* could be eliminated and replaced with a single, circular tab having a circumference slightly smaller than the flat surface 16 and pivotally mounted slightly off center on the flat surface 16. This off center pivot location would enable this circular tab to be rotated so that it extends beyond the cylindrical surface 13.

Accordingly, the spirit and scope of the following claims should not be limited to the description of the versions referenced herein.

What is claimed is:

1. A paint roller applicator having a handle, a rigid shaft extending from said handle and a cage rotatably attached to said rigid shaft, said cage having a handle end and a free end, said free end comprising:

(a) a free end cap mounted at the free end of said cage and having means for mounting a pivoting tab; and (b) a tab pivotally mounted on the free end cap such that the tab can be rotated into a position that keeps a brush on the cage and can be further rotated to enable a brush to be readily removed from or installed on said cage.

2. A paint roller applicator having a handle, a rigid shaft extending from said handle and a cage rotatably attached to said rigid shaft, said cage having a handle end and a free end, said free end comprising:

(a) a free end cap mounted at the free end of said cage and having means for mounting pivoting tabs; and (b) tabs pivotally mounted on the free end cap such that the tabs can be rotated into a position that keeps a brush on the cage and can be further rotated to enable a brush to be readily removed from or installed on said cage.

* * * * *